US010677031B2

(12) United States Patent
Xiao et al.

(10) Patent No.: US 10,677,031 B2
(45) **Date of Patent: *Jun. 9, 2020**

(54) INTEGRATED PUMP AND COMPRESSOR AND METHOD OF PRODUCING MULTIPHASE WELL FLUID DOWNHOLE AND AT SURFACE

(71) Applicant: Saudi Arabian Oil Company, Dhahran (SA)

(72) Inventors: Jinjiang Xiao, Dhahran (SA); Randall Alan Shepler, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 292 days.

This patent is subject to a terminal disclaimer.

(21) Appl. No.: 15/784,951

(22) Filed: Oct. 16, 2017

(65) Prior Publication Data

US 2018/0038210 A1 Feb. 8, 2018

Related U.S. Application Data

(63) Continuation of application No. 14/313,117, filed on Jun. 24, 2014, now Pat. No. 9,915,134.

(Continued)

(51) Int. Cl.
*E21B 43/12* (2006.01)
*F04B 47/06* (2006.01)

(Continued)

(52) U.S. Cl.
CPC ..... *E21B 43/128* (2013.01); *E21B 21/002* (2013.01); *E21B 43/38* (2013.01);

(Continued)

(58) Field of Classification Search
CPC ..... E21B 43/128; E21B 21/002; E21B 43/38; F04D 13/10; F04D 13/14; F04D 29/043;

(Continued)

(56) References Cited

U.S. PATENT DOCUMENTS 2,556,435 A * 6/1951 Moehrl ..... H02K 9/19 417/367
5,482,117 A 1/1996 Kolpak (Continued)

FOREIGN PATENT DOCUMENTS

CN 1507531 6/2004
GB 2226776 7/1990

(Continued)

OTHER PUBLICATIONS

Abelsson et al., "Development and Testing of a Hybrid Boosting Pump," Offshore Technology Conference (OTC 21516), May 2-5, 2011, Houston, TX, 9 pages.

(Continued)

*Primary Examiner* — Blake E Michener
(74) *Attorney, Agent, or Firm* — Fish & Richardson P.C.

(57) ABSTRACT

An integrated system is disclosed to handle production of multiphase fluid consisting of oil, gas and water. The production stream is first separated into two streams: a liquid dominated stream (GVF<5% for example) and a gas dominated stream (GVF>95% for example). The separation can be done through shrouds, cylindrical cyclonic, gravity, in-line or the like separation techniques. The two streams are then routed separately to pumps which pump dissimilar fluids, such as a liquid pump and a gas compressor, and subsequently recombined. Both pumps are driven by a single motor shaft which includes an internal passageway associated with one of the pumps for reception of the fluid from the other pump, thereby providing better cooling and greater overall efficiency of all systems associated therewith. A method for providing artificial lift or pressure boosting of multiphase fluid is also disclosed.

10 Claims, 4 Drawing Sheets

Related U.S. Application Data

(60) Provisional application No. 61/838,761, filed on Jun. 24, 2013.

(51) Int. Cl.

| | |
|---|---|
| ***E21B 43/38*** | (2006.01) |
| ***F04B 23/04*** | (2006.01) |
| ***F04B 47/02*** | (2006.01) |
| ***E21B 21/00*** | (2006.01) |

(52) U.S. Cl.
CPC ..... *F04B 23/04* (2013.01); *F04B 47/02* (2013.01); *F04B 47/06* (2013.01)

(58) Field of Classification Search
CPC ..... F04D 29/053; F04D 47/06; F04D 23/04; F04D 47/02
See application file for complete search history.

(56) References Cited

U.S. PATENT DOCUMENTS

| | | | | |
|---|---|---|---|---|
| 5,605,193 | A | 2/1997 | Bearden et al. | |
| 5,755,288 | A | 5/1998 | Bearden et al. | |
| 6,113,675 | A | 9/2000 | Branstetter | |
| 6,164,308 | A | 12/2000 | Butler | |
| 6,601,651 | B2 | 8/2003 | Grant | |
| 7,338,262 | B2 | 3/2008 | Gozdawa | |
| 2002/0121376 | A1 | 9/2002 | Rivas | |
| 2002/0153141 | A1* | 10/2002 | Hartman | E21B 43/128 166/302 |
| 2005/0217859 | A1 | 10/2005 | Hartman | |
| 2008/0093084 | A1 | 4/2008 | Knight | |
| 2009/0151928 | A1 | 6/2009 | Lawson | |
| 2010/0258306 | A1 | 10/2010 | Camilleri | |
| 2011/0162832 | A1 | 7/2011 | Reid | |
| 2013/0068454 | A1 | 3/2013 | Armistead | |
| 2013/0259721 | A1 | 10/2013 | Noui-Mehidi | |
| 2015/0233228 | A1 | 8/2015 | Roth | |
| 2015/0308444 | A1* | 10/2015 | Trottmann | E21B 43/128 415/1 |
| 2017/0292533 | A1* | 10/2017 | Zia | E21B 43/128 |

FOREIGN PATENT DOCUMENTS

| | | |
|---|---|---|
| WO | 2002072998 | 9/2002 |
| WO | 2011066050 | 6/2011 |
| WO | 2011101296 | 8/2011 |

OTHER PUBLICATIONS

Geary et al., "Downhole Pressure Boosting in Natural Gas Wells: Results from Prototype Testing," Society of Petroleum Engineers (SPE 116405), SPE Asia Pacific Oil and Gas Conference and Exhibition, Oct. 20-22, 2008, Australia, 13 pages.

Schlumberger, "AGH: Advanced Gas-Handling Device," Product Sheet, Jan. 2014, 2 pages, <http://www.slb.com/~/media/Files/artificial_lift/product_sheets/ESPs/advanced_gas_handling_ps.pdf>.

Baker Huges, "Multiphase Pump: Increases Efficiency and Production in Wells with High Gast Content," Brocure overview, 2014, 2 pages; <https://assets.www.bakerhughes.com/system/69/00d970d9dd11e3a411ddf3c1325ea6/28592.MVP_Overview.pdf>.

Office Action issued in Chinese Application No. 201480038838.8 dated Jun. 2, 2017; 19 pages.

Decision to Grant issued by the Patent Office of the Cooperation Council for the Arab States of the Gulf in Gulf Cooperation Council Application No. 2014/27391 dated May 25, 2017; 4 pages.

International Search Report and Written Opinion issued in International Application No. PCT/US2014/043806 dated Mar. 6, 2015; 10 pages.

* cited by examiner

INTEGRATED PUMP AND COMPRESSOR AND METHOD OF PRODUCING MULTIPHASE WELL FLUID DOWNHOLE AND AT SURFACE

CROSS-REFERENCE TO RELATED APPLICATIONS

This application is a continuation application of and claims the benefit of priority to U.S. application Ser. No. 14/313,117, filed on Jun. 24, 2014, which claims the benefit of priority to U.S. Provisional Application Ser. No. 61/838,761, filed Jun. 24, 2013, the contents of which are hereby incorporated by reference.

BACKGROUND OF THE INVENTION

1. Field of the Invention

The present invention relates to a system and method for producing multiphase fluid (i.e., oil, gas and water) either downhole or at surface using artificial lift methods such as Electric Submersible Pump (ESP), Wet Gas Compressor (WGC) and Multi-Phase Pump (MPP).

2. Description of the Related Art

Downhole artificial lift or surface pressure boosting are often required to increase hydrocarbon production and recovery. The production fluids are often a mixture of gas, oil and water. In the case of an oil well, the operating pressure downhole can be below the bubble point pressure or the well can have gas produced from the gas cap together with the oil. For gas wells, the gas is often produced with condensate and water.

Electric Submersible Pump (ESP) is an artificial lift method for high volume oil wells. The ESP is a device which has a motor close-coupled to the pump body. The entire assembly is submerged in the fluid to be pumped. The ESP pump is generally a multistage centrifugal pump can be hundreds of stages, each consisting of an impeller and a diffuser. The impeller transfers the shaft's mechanical energy into kinetic energy of the fluids, and the diffuser converts the fluid's kinetic energy into fluid head or pressure. The pump's performance depends on fluid type, density and viscosity. When free gas is produced along with the oil and water, gas as bubbles can build up on the low pressure side of the impeller vanes. The presence of gas reduces the head generated by the pump. In addition, the pump volumetric efficiency is reduced as the gas is filing the impeller vanes. When the amount of free gas exceeds a certain limit, gas lock can occur and the pump will not generate any head/pressure.

To improve ESP performance, a number of techniques have been developed. These solutions can be classified as gas separation/avoidance and gas handling. Separation and avoidance involves separating the free gas and preventing it from entering into the pump. Separation can be done either by gravity in combination with special completion design such as the use of shrouds, or by gas separators installed and attached to the pump suction. The separated gas is typically produced to the surface through the tubing-casing annulus. However, this may not always be a viable option in wells requiring corrosion protection through the use of deep set packers to isolate the annulus from live hydrocarbons. In such environments, the well will need to be completed with a separate conduit for the gas. To utilize the gas lift benefit, the gas can be introduced back to the tubing at some distance from the pump discharge after pressure equalization is reached between the tubing and gas conduit. To shorten the distance, a jet pump can be installed above the ESP to "suck" in the gas. All these options add complexity to well completion and well control.

Gas handling is to change the pump stage design so that higher percentage of free gas can be tolerated. Depending on the impeller vane design, pumps can be divided into the following three types: radial, mixed and axial flow. The geometry of radial flow pump is more likely to trap gas in the stage vanes and it can typically handle gas-volume-fraction (GVF) up to 10%. In mixed flow stages, since the fluid mixture has to go through a more complex flow pass, mixed flow pumps can typically handle up to 25% free gas with some claiming to be able to handle up to 45% free gas. In an axial flow pump, the flow direction is parallel to the shaft of the pump. This geometry reduces the possibility to trap gas in the stages and hence to gas lock. Axial pump stages can handle up to 75% free gas, but have poor efficiency compared to mixed flow stages.

For gas wells, as fields mature and pressure declines, artificial lift will be needed to maintain gas production. Conventional artificial lift with ESP, Progressing Cavity Pump (PCP), and Rod pump all requires separation of gas from liquid. The liquid will be handled by pumps and the gas will flow naturally to surface. Downhole Wet Gas Compressor (WGC) is a new technology that is designed to handle a mixture of gas and liquid. Yet, at the current stage, it still has a limited capability to handle liquid.

At the surface, the conventional approach is to separate the production into gas and liquid and use a pump for the liquid and a compressor for the gas. Two motors are required with this approach, which results in a complex system. Surface MPP and WGC are costly, complex and many times still suffer from reliability issues.

There is presently a need to develop a compact system for downhole artificial lift or surface pressure boosting that works satisfactorily with a wide range of GVF. We have invented a system and method for producing such multiphase fluid downhole and at surface, with resultant overall improved efficiency.

SUMMARY OF THE INVENTION

An integrated system is disclosed to handle production of multiphase fluid consisting of oil, gas and water. The production stream is first separated into two streams: a liquid dominated stream (GVF<5% for example) and a gas dominated stream (GVF>95% for example). The separation can be done through gravity, shrouds, or cylindrical cyclonic separation techniques. The two streams are then routed separately to a liquid pump and a gas compressor, and subsequently recombined. Alternatively for downhole applications, the separate flow streams may be brought to the surface separately, if desired. The system can be used to produce artificial lift or surface pressure boosting downhole or at surface.

Both the pump and compressor are driven by a single motor shaft which includes an internal passageway associated with one of the machineries for reception of the fluid from the other machinery, thereby providing better cooling and greater efficiency of all systems associated therewith.

The pump and compressor are each designed best to handle liquid and gas individually and therefore the integrated system can have an overall higher efficiency. The present invention is compact and produces downhole artificial lift and surface pressure boosting, particularly in offshore applications. Furthermore, depending upon the specific separation technique employed, the production fluids can be arranged to provide direct cooling of the motor, as in conventional ESP applications.

A significant feature of the present invention is that the pump and compressor share a common shaft which is driven by the same electric motor. For surface applications, the drive means can also be the same diesel or gasoline engine. In one embodiment, the compressor portion of the shaft is hollow to provide a flow path for the liquid discharged from the pump. In another embodiment, the pump portion of the shaft is hollow to provide a flow path for the gas discharged from the compressor. Optionally, a gearbox can be added between the compressor or pump so the two can be operated at different speed.

The hybrid, coaxial pump and compressor system of the present invention is compact, and is particularly suitable for downhole artificial lift applications for gassy oil wells or wet gas producers. It also has applications for surface pressure boosting, especially on offshore platforms where spaces are always limited and costly.

The invention incorporates mature pump and compressor technologies, and integrates them in an innovative way for multiphase production applications where an individual device would not be suitable if it is made to handle the mixture of oil, gas and water.

The present invention does not require a specific type of pump or compressor. It is effective by integrating existing mature pump and compressor technologies in such structural and sequential arrangements, whereby unique multiphase production is facilitated with a wide range of free gas fraction. The pump and compressor are coupled onto the same shaft so that a single motor can be used to drive both devices. In one embodiment a portion of the compressor shaft is hollow to allow fluid passage.

In another embodiment, a portion of the shaft associated with the pump can be hollow to receive gas to provide a flow path for gas discharged from the compressor.

In either embodiment, a certain amount of beneficial and stabilizing heat transfer will take place.

The present invention utilizes a single motor to drive a pump and a compressor simultaneously, with particular features which direct the liquids and the gases in distinct directions. As noted, the pump and compressor can be of any design within the scope of the invention, and each embodiment can operate at its own best efficiency conditions in terms of gas or liquid tolerance. The elimination of the second motor, as well as the unique structural arrangements of the present invention, make the present system ideal for downhole and well site surface applications.

As will be seen from the description which follows, the total production stream is first separated into a liquid dominant stream and a gas dominant stream. As noted, the separation can be realized in a number ways such as gravity, centrifugal or rotary gas separator, gas-liquid cylindrical cyclonic, in-line separator. A pump is used to provide artificial lift or pressure boosting to the liquid dominant stream, and a compressor is used to provide pressure boosting for the gas dominant stream. The pump and compressor can be radial, mixed or axial flow types. The two devices are on the same shaft which is driven by the same motor or fuel engine as in the case of surface applications.

A method is also disclosed for producing multiphase fluid (oil, gas and water), either downhole or at surface. The system combines a pump for handling a liquid dominant stream and a compressor for handling a gas dominant stream. The pump and compressor share a common shaft, driven by the same electric motor or fuel engine in the case of surface applications. The portion of the shaft for the compressor is hollow, which serves as a flow path for the liquid discharged from the pump. The production fluid may be passed through a cooling jacket to provide cooling for the motor, and the separated liquid also provides cooling for the compressor, which improves the efficiency of the compressor. The compressed gas and the pumped liquid are combined at the compressor outlet, or at the pump outlet, depending upon the preferred sequential arrangement of the components of the individual system. The system has a broad Gas-Volume-Fraction (GVF) operating range and is compact for downhole and onshore/offshore wellhead uses.

The present inventive method is also effective when a portion of the shaft associated with pump is hollow to provide a flow path for gas discharged from the compressor, thereby facilitating stabilizing heat transfer throughout the system components.

BRIEF DESCRIPTION OF THE DRAWINGS

Preferred embodiments of the invention are disclosed hereinbelow with reference to the drawings, wherein.

DETAILED DESCRIPTION OF THE PREFERRED EMBODIMENTS

Figure 1:
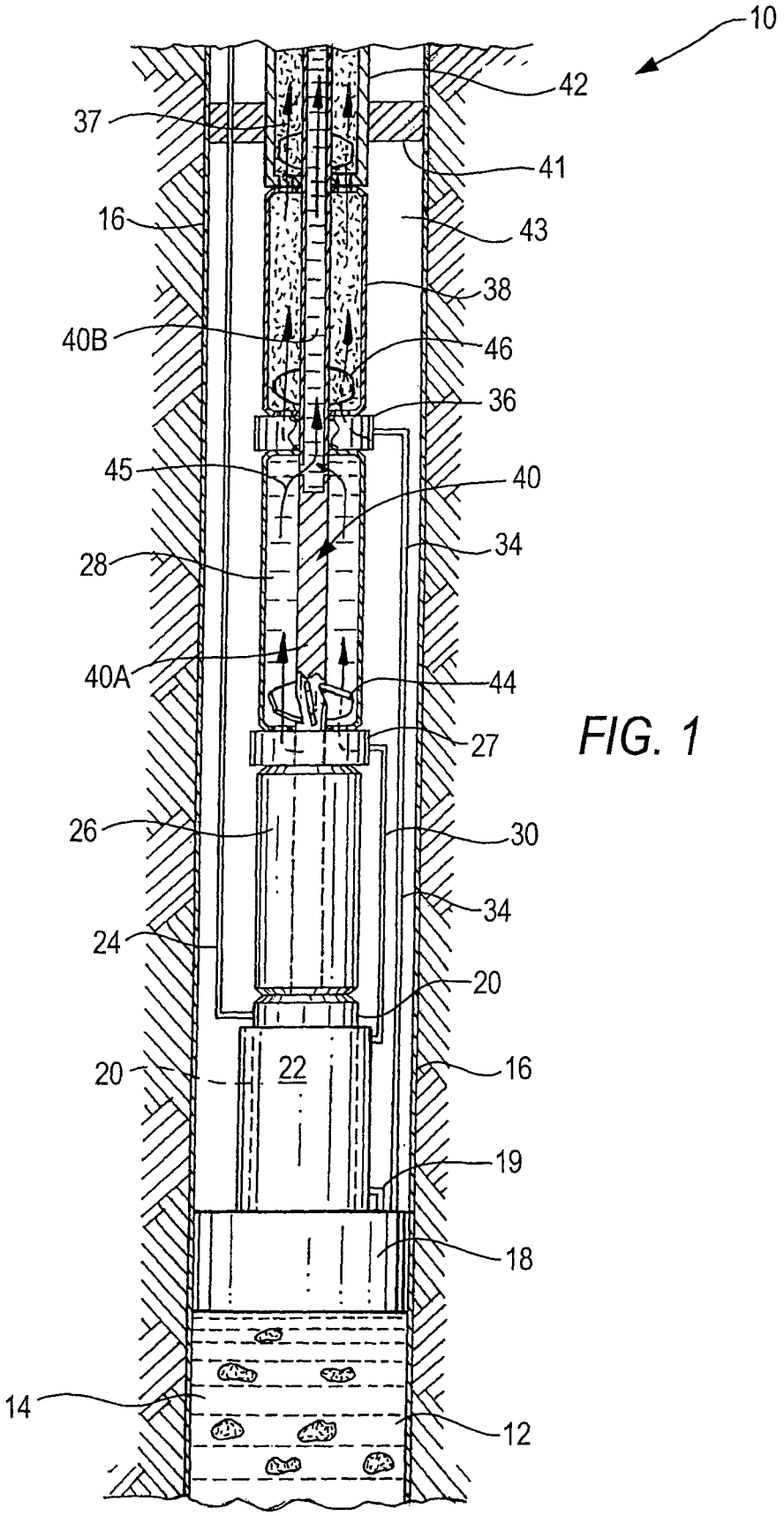
FIG. 1 is an elevational view, partially in cross-section, of a combination liquid pump/gas compressor arrangement constructed according to the present invention, the arrangement shown in a vertical orientation and adapted to flow fluids upwardly from a well location downhole.

One preferred embodiment of the present invention is illustrated in FIG. 1, which is an elevational view, partially in cross-section, of a combination liquid pump/gas compressor 10 shown downhole in a vertical orientation. A typical portion of a well 12 contains a liquid/gas mixture 14, and is provided with a suitable casing sleeve 16 which extends downhole to where the liquid/gas mixture 14 exists.

Downstream of the liquid/gas supply is liquid/gas separator 18, which is shown schematically in FIG. 1, and which may be any one of several known types of separators, such as those which utilize gravity, shrouds, centrifugal or rotary gas separation, or gas-liquid cylindrical cyclonic, in-line separation technology, or the like.

Downstream of separator 18 is drive motor 20, encased in cooling jacket 22. The motor 20 can be powered from the surface by known means, including electric power or the like delivered to drive motor 20 by power cable 24. Production fluids are directed to cooling jacket 22 from separator 18 via feed line 19 if needed.

In FIG. 1, seal 26 provides an interface between drive motor 20 and liquid pump 28, which is supplied with liquid medium separated by separator 18 from the liquid/gas mixture 14, and is directed via liquid feed line 30 to pump intake 27, and then to liquid pump 28. Gas feed line 34 directs gas separated by separator 18 from the liquid/gas mixture 14 directly to compressor intake 36, and then to gas compressor 38, as shown. Both feed lines 30 & 34 are optional.

The drive shaft 40 of the drive motor 20 extends through, and drives both the liquid pump and the gas compressor, as will be shown and described in the description which follows.

The portion 40A of shaft 40 is associated with liquid pump 28, and the portion 40B of shaft 40 is associated with compressor 38. The shaft 40 is commonly driven in its entirety by motor 22.

In FIG. 1, the portion 40A of the shaft 40 associated with liquid pump 28 is solid as shown, and the portion 40B associated with gas compressor 38 is hollow to receive the flow of the liquid discharged from the pump 28 so as to provide cooling to the gas compressor 38. This cooling effect enhances compressor efficiency and reduces the horsepower requirement for operating the compressor. The flow of gas 37 from the gas compressor 38 is discharged into the outlet tube 42, where it may be combined with the liquid component as shown. As can be seen, outlet tubing 42 is surrounded by deep packer 41 positioned within the annulus 43 formed by outlet tube 42 and casing 16. In particular, FIG. 1 shows how the present invention can be effectively deployed downhole to provide artificial lift.

In FIG. 1, liquid pump blades 44 and gas compressor blades 46 are shown in a single stage format for illustration purposes. In practice, such blades may be provided in multiple stages, sometimes numbering in tens of hundreds of such stages of blades.

Figure 2:
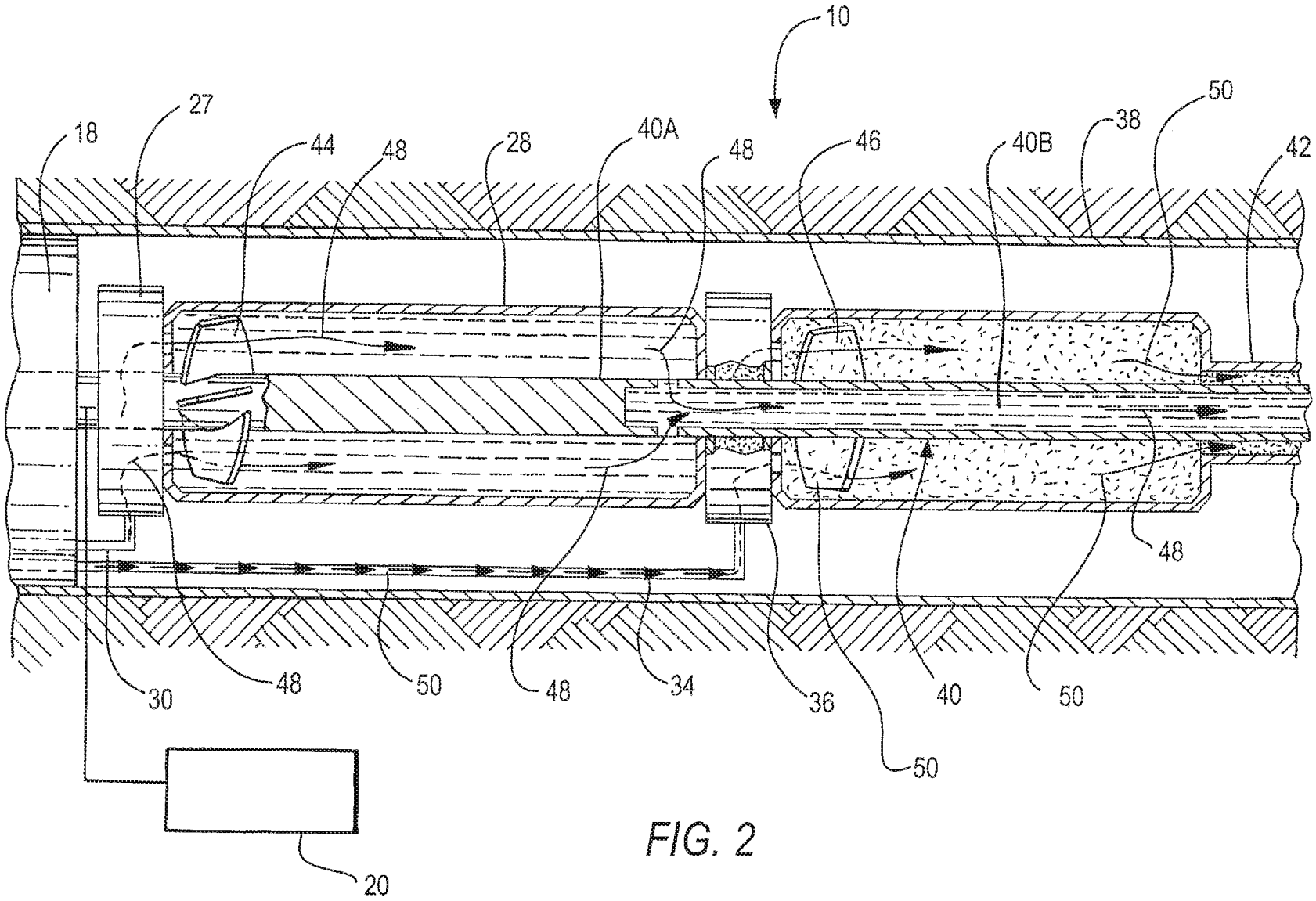
FIG. 2 is an enlarged elevational cross-sectional view of a liquid pump and gas compressor similar to FIG. 1, the arrangement shown in a horizontal orientation, and the single motor shown in schematic format for convenience of illustration.

Referring now to FIG. 2, an enlarged elevational cross-sectional view of the liquid pump 28 and gas compressor 38 of FIG. 1 is shown, in a horizontal orientation.

Separator 18 is shown schematically in FIG. 2, but can be of any desired type as noted previously, i.e., cylindrical cyclonic, gravity, in-line, or the like. Motor 20 is shown in schematic format in FIG. 2, and is arranged to drive the common shaft 40, comprised in part of liquid pump portion 40A and gas compressor portion 40B, similar to the arrangement shown in FIG. 1.

After the separation process which takes place at separator 18, the liquid dominant stream 48 is directed via liquid feed line 30 to pump intake 27 of liquid pump 28 as shown, and then directed from liquid pump 28 to the hollow portion 40B of shaft 40 associated with gas compressor 38.

The gas dominant stream 50 is in turn directed from separator 18 via gas feed line 34 directly to compressor intake 36 and then to gas compressor 38, where it is compressed, pumped and directed to outlet tube 42 to be combined with the liquid dominant stream flowing through the hollow shaft portion 40B of gas compressor 38.

In FIGS. 1 and 2, liquid feed line 30 and gas feed line 34 are shown schematically, but can be representative of any known system to convey the respective dominant liquid or dominant gas medium from one place to another. As will be seen, the dominant liquid medium and dominant gas medium may be transferred from place to place to facilitate better heat transfer between the components of the system.

Figure 3:
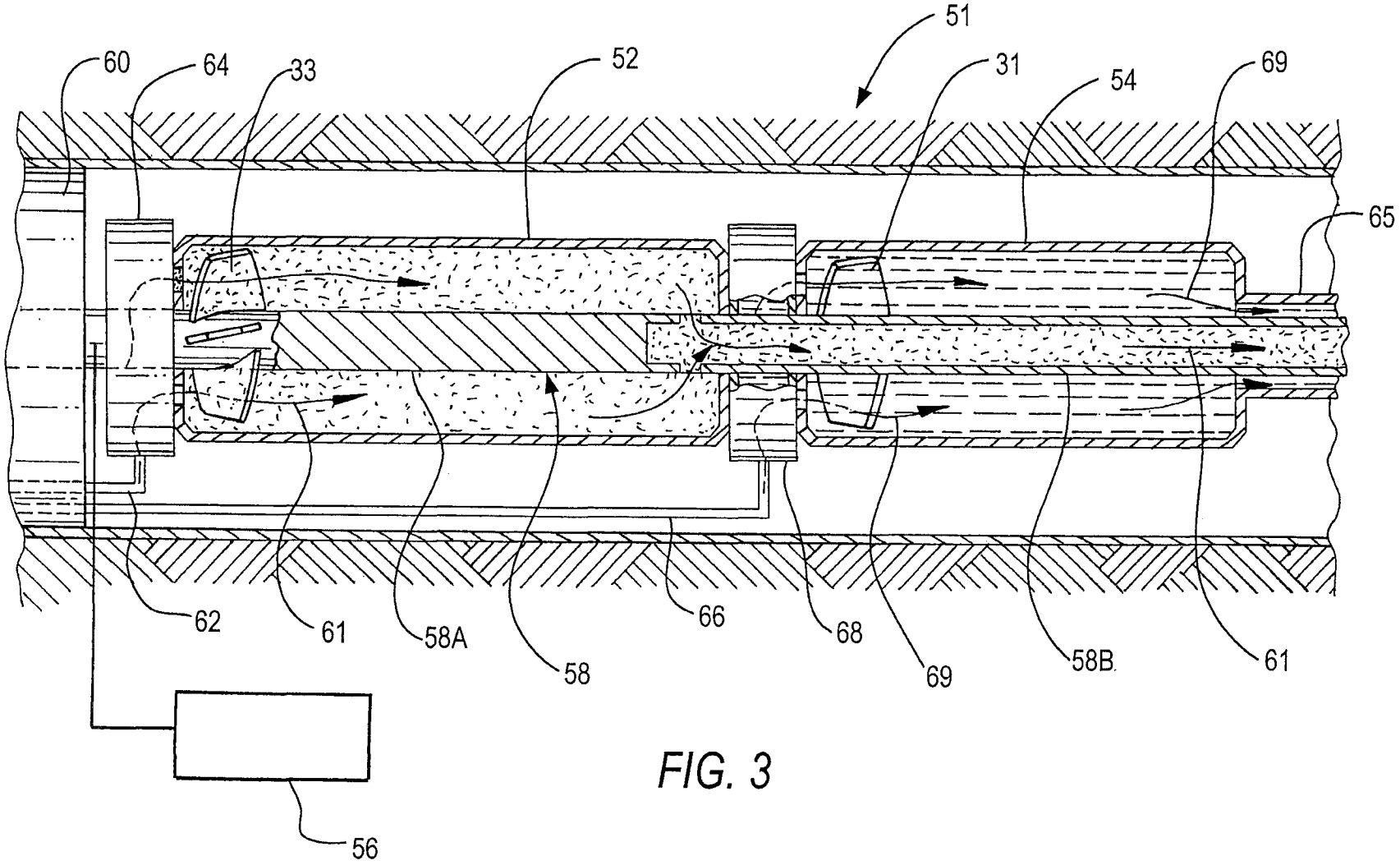
FIG. 3 is an enlarged elevational cross-sectional view of an alternative embodiment of the liquid pump/gas compressor arrangement similar to FIGS. 1 and 2, with the positions of the liquid pump and gas compressor being respectively reversed, the pump portion of the shaft being hollow to provide a flow path for the gas discharged from the compressor.

Referring now to FIG. 3, there is shown an enlarged elevational cross-sectional view of an alternative embodiment 51 of the liquid pump/gas compressor arrangement of FIGS. 1 and 2, with the respective positions of the gas compressor 52 and the liquid pump 54 in respectively reversed positions and configurations. Liquid pump blades 31 and gas compressor blades 33 are shown.

In FIG. 3, motor 56 is shown schematically to rotatably operate the drive shaft 58 which is common to both gas compressor 52 and liquid pump 54. In this embodiment the shaft portion 58A associated with gas compressor 52 is solid, and gas is pumped through the gas compressor 52 in the annular zone surrounding the solid shaft portion 58A. The gas dominant stream 61 is directed from separator 60 via gas feed line 62 shown schematically, to compressor intake 64, and then to gas compressor 52.

The liquid dominant stream 69 from separator 60 is directed via liquid feed line 66 to liquid pump intake 68, and then to liquid pump 54 where it is pumped as liquid dominant stream 69 toward outlet tube 65 to be recombined with the gas dominant stream 61 from hollow shaft portion 58B associated with liquid pump 54. It can be seen that the simultaneous flow of gas dominant stream 61 through hollow shaft portion 58B and the liquid dominant stream 69 through liquid pump 54 provides a stabilizing heat exchange between the various components, which are commonly driven by a single motor 56. This feature significantly improves the efficiency of all working components. The respective streams are combined in outlet tube 65 in FIG. 3.

As noted previously, the pump and compressor systems shown in the FIGS. respectively depict a single stage of blades, for convenience of illustration. In reality, the pump and compressor systems according to the invention incorporate multiple stages of such blade systems, occasionally numbering tens of hundreds of blade stages, sometimes including an impeller and diffuser.

Figure 4:
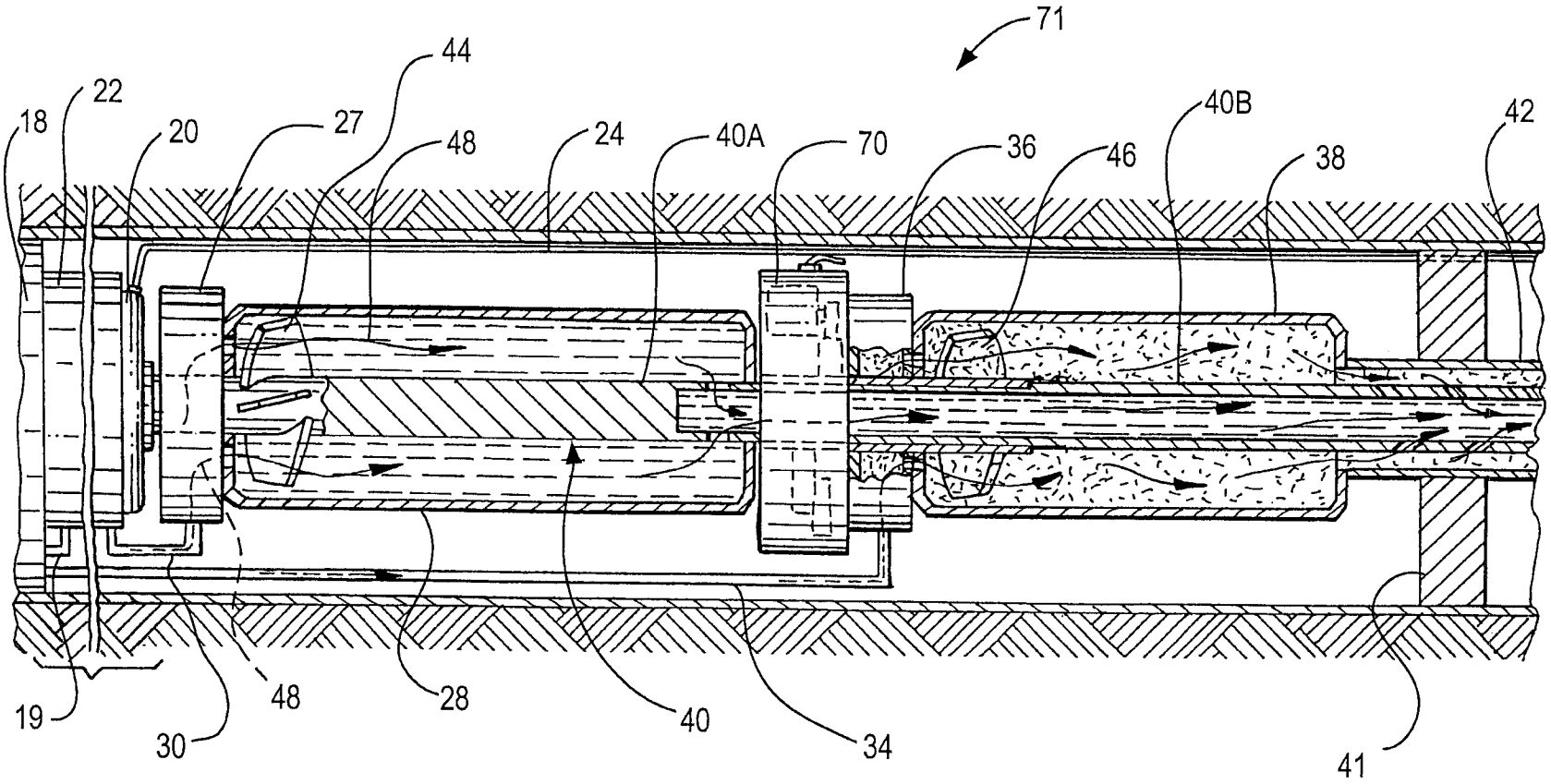
FIG. 4 is an elevational cross-sectional view of a combination liquid pump/gas compressor similar to the previous FIGS., and particularly of FIG. 1, but including an optional gearbox positioned between the liquid pump and gas compressor to facilitate operation of each unit at respectively different speeds.

Referring now to FIG. 4, there is shown an alternative embodiment 71 similar to the structural arrangement of FIG. 1, with the addition of gearbox 70 positioned between liquid pump 28 and gas compressor 38 to facilitate operation of each component at respectively different speeds so as to accommodate specific conditions for any specific environment, such as well conditions, fluid viscosity and other flow conditions.

In all other respects, the structural and functional arrangement in FIG. 4 is the same as the arrangement shown in FIG. 1.

While the invention has been described in conjunction with several embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

LIST OF NUMERALS

10 Combination Liquid Pump/Gas Compressor
12 Well
14 Liquid/Gas Mixture
16 Casing Sleeve
18 Liquid/Gas Separator
19 Feed Line
20 Drive Motor
22 Cooling Jacket
24 Power Cable
26 Seal

27 Liquid Pump Intake
28 Liquid Pump
30 Liquid Feed Line
31 Liquid Pump Blades
32 Liquid Pump
33 Gas Compressor Blades
34 Gas Feed Line
36 Compressor Intake
37 Flow of Gas from Compressor 38
38 Gas Compressor
40 Drive Shaft
40A Liquid Pump Portion of Drive Shaft
40B Hollow Shaft Portion
41 Deep Packer
42 Outlet Tube
43 Annulus
44 Liquid Pump Blades
45 Flow of Liquid from Pump 28
46 Gas Compressor Blades
48 Liquid Dominant Stream
50 Gas Dominant Stream
51 Alternative Embodiment
52 Gas Compressor
54 Liquid Pump
56 Motor
58 Drive Shaft
58A Solid Shaft Portion of Compressor
58B Hollow Shaft Portion of Compressor
60 Separator
61 Gas Dominant Stream, FIG. 3
62 Gas Feed Line
64 Compressor Intake
65 Outlet Tube
66 Liquid Feed Line
68 Liquid Pump Intake
69 Liquid Dominant Stream, FIG. 3
70 Gearbox
71 Alternative Embodiment

The invention claimed is:

1. A system comprising:

a first pumping device configured to receive and pump a first single phase-dominant stream of a multiphase fluid;

a second pumping device configured to receive and pump a second single phase-dominant stream of the multiphase fluid; and a power source configured to simultaneously drive the first pumping device and the second pumping device, the power source comprising a drive shaft common to the first pumping device and the second pumping device, the drive shaft comprising:

a solid portion located within the first pumping device, and a hollow portion located within the second pumping device, the hollow portion configured to receive the first single phase-dominant stream pumped by the first pumping device.

2. The system of claim 1, wherein the first single phase-dominant stream and the second single phase-dominant stream flow together in a multiphase fluid towards the first pumping device and the second pumping device, and wherein the system comprises a separator configured to separate the multiphase fluid into the first single phase-dominant stream and the second single phase-dominant stream.

3. The system of claim 1, wherein the first single phase-dominant stream is a liquid phase-dominant stream, wherein the first pumping device comprises a liquid pump.

4. The system of claim 3, wherein the second single phase-dominant stream is a gas phase-dominant stream, wherein the second pumping device comprises a gas compressor.

5. The system of claim 1, further comprising an outlet tube attached to an outlet end of the second pumping device, the outlet tube configured to receive the second single phase-dominant stream from the second pumping device.

6. The system of claim 5, wherein the outlet tube is configured to receive the first single phase-dominant stream from an outlet end of the first pumping device and mix the first single phase-dominant stream with the second single-phase dominant stream.

7. The system of claim 5, wherein the system is configured to be positioned within a wellbore, wherein an outer surface of the system and an inner wall of the wellbore define an annulus, and wherein the system further comprises a packer positioned within the annulus.

8. The system of claim 1, wherein the first single phase-dominant stream is a gas phase-dominant stream, wherein the first pumping device comprises a gas compressor.

9. The system of claim 8, wherein the second single phase-dominant stream is a liquid phase-dominant stream, wherein the second pumping device comprises a liquid pump.

10. The system of claim 1, further comprising a gearbox positioned between the first pumping device and the second pumping device, the gearbox configured to operate the first pumping device or the second pumping device at different pumping speeds.

* * * * *